United States Patent [19]

Slunecka et al.

[11] Patent Number: 4,833,797

[45] Date of Patent: May 30, 1989

[54] TRENCHER ATTACHMENT

[75] Inventors: Leslie J. Slunecka; Calvin H. Hansen, both of Sioux Falls; Leroy B. Stumpe, Hartford, all of S. Dak.

[73] Assignee: Du-al Manufacturing Company, Sioux Falls, S. Dak.

[21] Appl. No.: 46,511

[22] Filed: May 6, 1987

[51] Int. Cl.[4] ..... E02F 5/06

[52] U.S. Cl. ..... 37/86; 37/80 R

[58] Field of Search ..... 37/80 R, 86, 83, 87, 37/84, 85, DIG. 17; 172/123

[56] References Cited

U.S. PATENT DOCUMENTS

| | | | |
|---|---|---|---|
| 2,817,167 | 12/1957 | Barber | 37/86 A |
| 2,846,786 | 8/1958 | Barber et al. | 37/86 |
| 3,044,194 | 7/1962 | Balkheimer | 37/86 A |
| 3,057,088 | 10/1962 | George et al. | 37/86 A |
| 3,633,679 | 1/1972 | Dahlberg | 172/386 |
| 4,483,084 | 11/1984 | Caldwell et al. | 37/86 |

*Primary Examiner*—Paul T. Sewell
*Assistant Examiner*—Huong Q. Pham
*Attorney, Agent, or Firm*—Hill, Van Santen, Steadman & Simpson

[57] ABSTRACT

A tractor with a trencher and a blade or shovel on the front of the tractor, the trencher connected to the tractor by a three-point hitch, the trencher having a boom pivotal up and down and a pair of laterally spaced swivel wheels beneath the trencher supported on arms pivoted to the frame and extending rearwardly with the pivotal arms connected to the frame at a location forward of the center of gravity of the trencher.

1 Claim, 3 Drawing Sheets

TRENCHER ATTACHMENT

BACKGROUND OF THE INVENTION

The invention relates to improvements in earth moving equipment, and more particularly to a tractor with a trencher and the trencher constructed so as to be essentially self-supporting and accommodate earth moving equipment on the front of the tractor and movement of the tractor in an arcuate path and forward and backward without supporting the trencher on the tractor.

In earth moving handling and excavating equipment, one form of machine is a trencher which can be drawn forwardly and powered by a tractor. The trencher operates to dig a narrow trench of controllable depth for laying wire, piping and other underground equipment into the trench. After the trench is dug, the earth which is removed and is placed back in the trench to cover up the equipment. It is particularly advantageous if the same equipment can be used for closing the trench, such as the tractor which draws the trencher having a shovel or blade on the front to close the trench. In such operation it is necessary that the tractor be readily maneuverable so that it can be backed and turned in arcs to accurately direct the tractor and move the earth.

Power equipment must be utilized for operating the trencher which normally has a pivotal boom extending rearwardly with an endless chain on the boom and blades on the chain for digging the earth from the trench. Power for operating the chain and blades may be obtained from a prime mover on the trencher or from the power takeoff of the tractor. Power is also required for moving the trencher and tractor forwardly at a controlled slow rate. One factor which must be met by the equipment is that the relatively heavy weight of the trencher must be supported and this frequently and commonly is accomplished by supporting the trencher on the hydraulic lifted support arms on the tractor. Disadvantages are encountered in this in that the trencher is relatively heavy and a downward pulling force is encountered while the trencher is in operation in the ground which in many cases causes excessive stress on the tractor and requires that the hitch be so balanced that the front end of the tractor is not lifted off the ground. Attempts have been made to compensate for these problems, and for example U.S. Pat. No. 4,483,084 employs supporting wheels on the trencher. In the structure disclosed in this patent, the wheels are constructed such that they are driven in a forward direction and apply the forward driving force to both the tractor and trencher during operation. However, in addition to the limitations induced by this requirement, because of the necessity of a relatively rigid connection between the tractor and the trencher, the tractor can be only driven straight forward and not in an arcuate path. Also, the tractor can only be backed very carefully and the relative inflexibility of the structure makes it very difficult, if not impossible, to utilize the tractor with a blade or shovel on the front for closing the trench without having to go through the time consuming steps of unhitching and disconnecting the trencher from the tractor.

It is accordingly an object of the present invention to provide an improved trencher construction in combination with a tractor and an earth moving unit on the front wherein greater flexibility and capability is afforded than in structures heretofore available so that the tractor can be employed for closing the trenches and can be driven in an arcuate path and backed up without disconnecting the trencher.

A further object of the invention is to provide an improved trencher construction wherein supporting apparatus is provided for the trencher eliminating the need for a full support from the tractor and eliminating the hazards which occur in the unbalance created on a tractor due to the weight of the trencher and the operating forces encountered in the trencher which are transmitted to the tractor.

A still further object of the invention is to provide a trencher construction with a self-supporting wheel arrangement wherein the forces generated from the trencher due to the trencher weight and due to the forces of the trencher digging in the ground augment the weight distribution and operation of the tractor.

FEATURES OF THE INVENTION

In accordance with the principles of the invention, a trencher is connected on the back of a tractor through a three-point hitch with the two lower hitches being laterally apart equidistant from the center of the trencher and a third upper connection point being provided. The trencher and its frame are supported on a wheel means preferably comprising two laterally spaced wheels uniformly laterally spaced relative to the center of gravity of the trencher with the wheels each supported on swivel arms pivotally connected to the frame of the trencher at a point forward of the center of gravity. The swivel arm in forward motion of the tractor and trencher positions the wheels just forwardly of a lateral auger which carries the dirt away from the trench as the dirt is drawn out of the trench by the blades on the endless chain which is carried on the boom. When the boom is in the raised non-digging position, a portion of the weight of the trencher must be carried on the tractor. This is transmitted through the three-point hitch basically to the back wheels of the tractor increasing the traction on the ground for use of the tractor when it is used with a shovel or blade on the front of the tractor to reclose the trench. This resultant reaction force is even more pronounced when the trencher boom is in the lowered position and a downward force results on the trencher from the digging operation. As the difficulty of digging increases, this downward force increases thereby increasing the downward force on the tractor rear wheels increasing their traction. Yet, with the supporting trencher wheels being pivotally mounted, in the earth moving phase of operation, the tractor can be sharply maneuvered without having to remove the trencher from the tractor. Further, the boom has sufficient lateral flexibility so that in the event an arcuate trench has to be dug, the swivel wheels do not bind the trencher laterally and for reasonably large arcs, a curved trench can be dug. By arranging the swivel wheels on laterally rearwardly extending swivel arms, the wheels can be positioned rearwardly close in front of the auger so that good operational balance is attained. Yet, the wheels can be swivelled to a lateral position or a forward position when the tractor is turning or is backing.

Other objects, advantages and features will become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
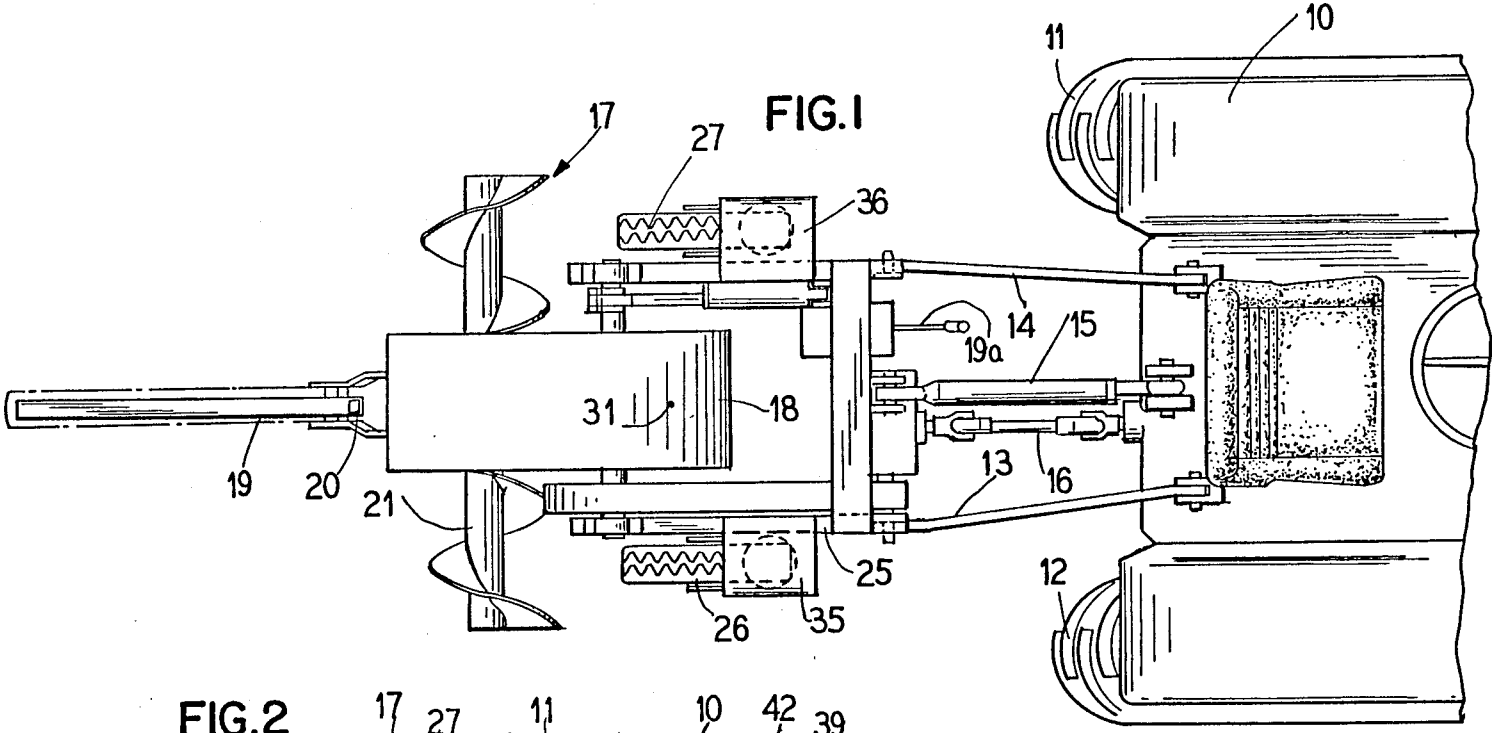
FIG. 1 is a top plan view of a tractor and trencher constructed and operating in accordance with the principles of the present invention.

The drawings show a tractor 10 having rear driving wheels 11 and 12. A three-point hitch is provided with rigid bars 13 and 14 extending horizontally rearwardly laterally spaced apart and essentially at the same level. The three-point hitch includes an upper rigid bar 15 which is at a higher level than the lower bars 13 and 14 and spaced therebetween.

Power for operating the earth excavating elements of the trencher is obtained from the power takeoff 16 of the tractor which connects through gearing and chain linkage to drive the excavating elements.

The trencher includes a rearwardly extendible pivotal boom 19 pivoted at **19*b* and carries an endless chain 22 with excavating blades 23 thereon. In operation a sprocket at 19*b* drives the endless chain and as the blades travel around the boom in a well known manner, earth is pulled upwardly to cut the trench and as the earth is pulled upwardly, it is distributed laterally by a rotating auger 21. Above the boom and the endless chain is a krumber mount. Suitable protective equipment and cowling for protecting the gears and chains are provided as generally shown at 18** and the details of the drive may take various forms and need not be specifically described inasmuch as they will be recognized and known by those versed in the art.

Figure 3:
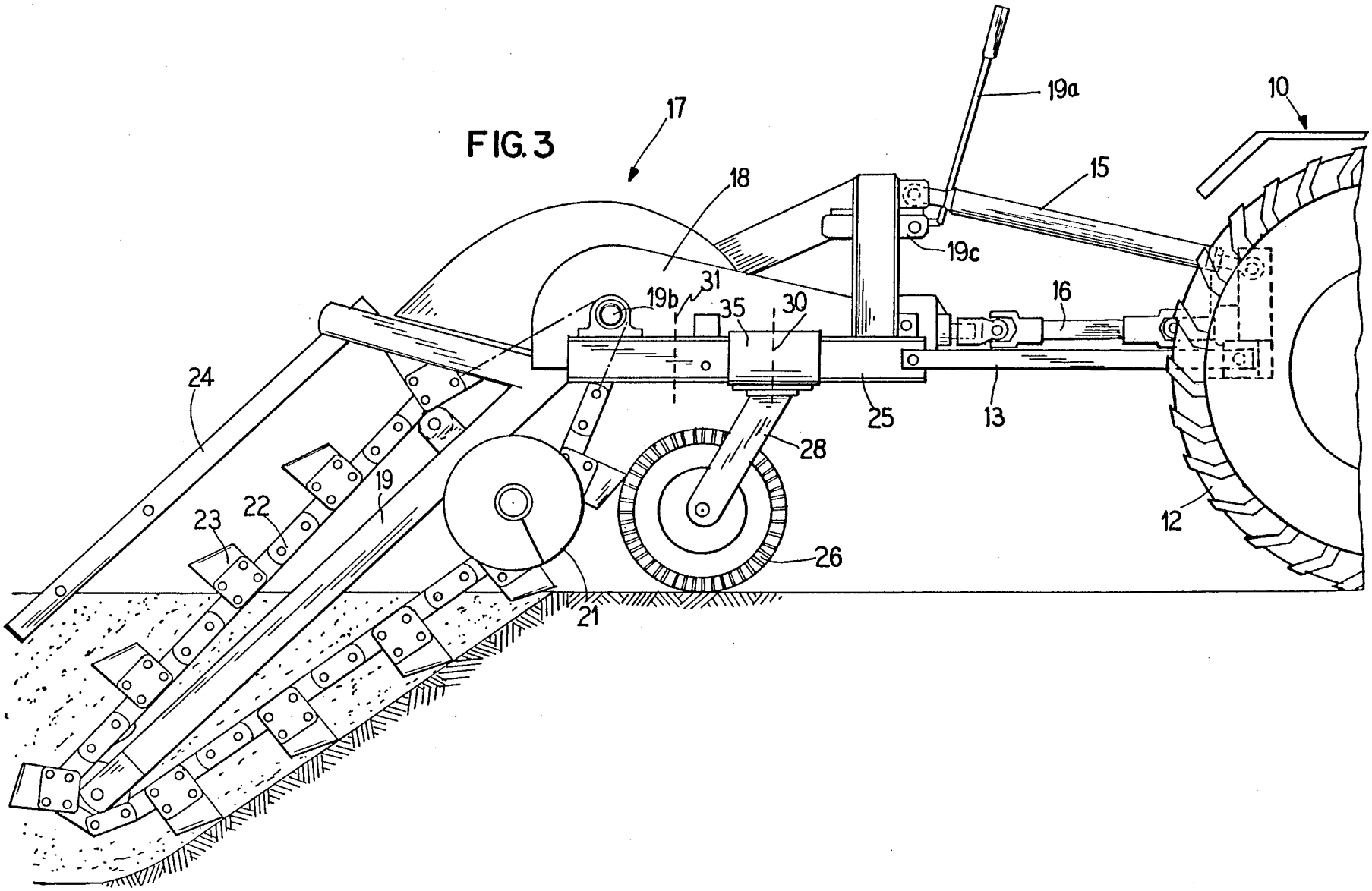
FIG. 3 is a side elevational view of the trencher as connected to the rear of a tractor.
Figure 6:
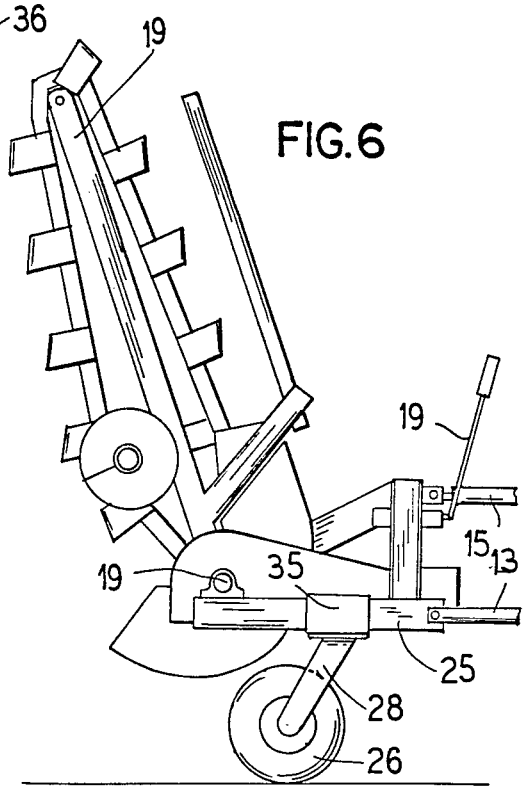
FIG. 6 is a side elevational view of the trencher showing the boom in raised non-digging position.

Suitable machinery is provided for moving the boom and its chain and blades to the operative digging position shown in FIG. 3 or to an elevated position as shown in FIG. 6, and this is controlled by a hydraulic boom control **19*a*, FIGS. 3 and 6. Suitable mechanical or hydraulic equipment is provided controlled by the boom control 19*a* and such equipment may include a hydraulic pump and cylinder and piston operated from the power takeoff 16, or the hydraulic pressure available from the tractor system may be utilized provided through snap-on hoses, not shown. The latter is the preferable arrangement and the hydraulic equipment with the hoses may be conveniently located at 19*c* at the base of the boom control 19**.

As the tractor is driven forwardly at a very slow controlled speed propelled by the wheels 11 and 12, the boom 19 is lowered into the earth a desired amount to cut a trench to the predetermined depth. As the earth is drawn upwardly by the blades, it is shifted laterally by the auger 21. When the trench has been cut, the boom is raised and the tractor is used as an earth moving piece of equipment utilizing either a blade or a scoop 40 at the front of the tractor as illustrated schematically in FIG. 2. The blade is mounted on controlled side arms 41 and 42 operated by the tractor operator.

The operator parts of the trencher are supported on a main frame 25 which is provided at its forward end for releasable connections for the three-point suspension arms 13, 14 and 15 of the tractor. The frame 25 also supports the mechanism driven by the power takeoff 16 for operating the trencher chain 22 and its boom 19 as well as the auger 21.

Figure 4:
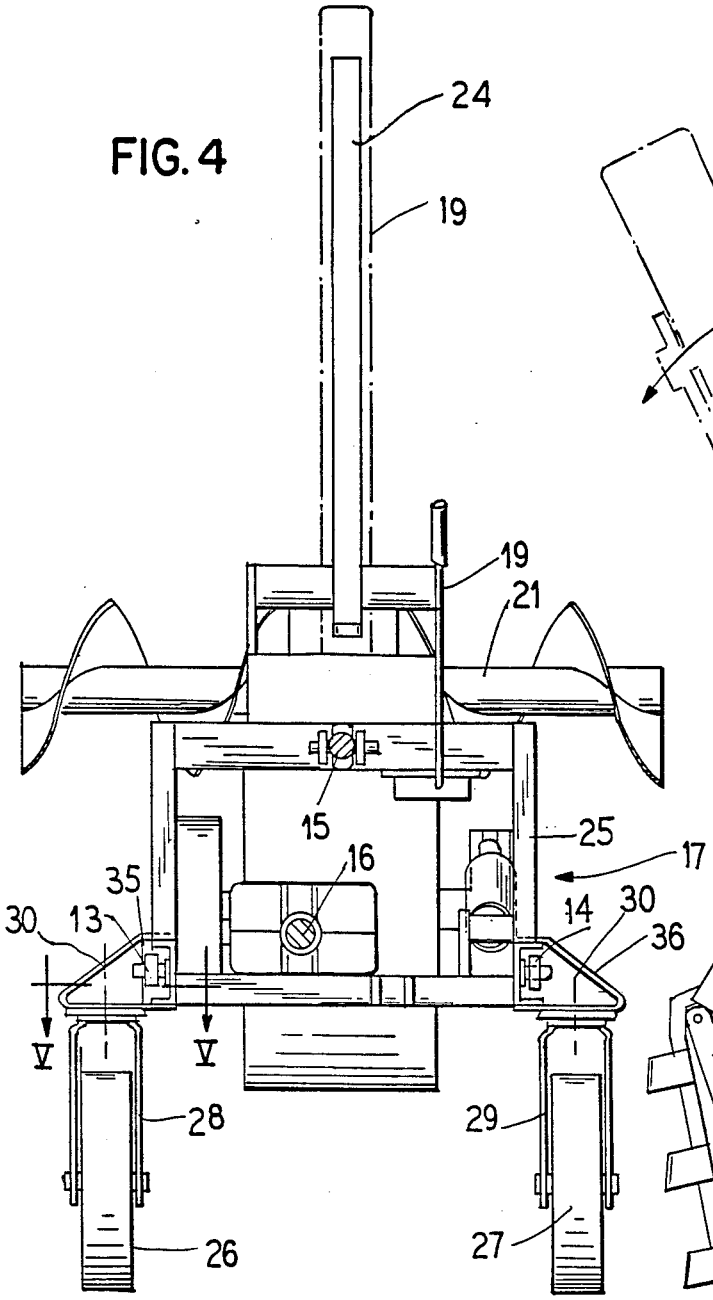
FIG. 4 is a front elevational view of the trencher showing the boom in raised position.

For supporting the weight of the trencher equipment and for unique controlled distribution of the forces on the trencher, namely the weight of the equipment and the vertical forces caused by the trencher blades 23 digging into the ground, the trencher is supported on laterally disposed wheels 26 and 27. These wheels are uniquely constructed as swivel wheels being carried on the lower ends of swivel arms 28 and 29. The swivel arms are pivotally mounted at their upper ends on the frame by mounting blocks 35 and 36, FIGS. 1, 3 and 4 so that each wheel swivels about a vertical axis 30 and **30*a* for the swivel arms 28 and 29** respectively.

The center of gravity of the trencher 17 is shown at 31 in FIGS. 1 and 3 and the swivel supports are arranged so that the access of the swivel at 30 and **30*a* is forward of the center of gravity 31. The swivel support arms 28 are angled so that the wheels 26 and 27 are in a trailing position relative to their arms in the forward movement of the tractor and trencher. When the tractor and trencher are turned, or are backed up, the swivel arms 28 and 29 permit the wheels to freely turn in their position to allow for turning or backing of the tractor such as would occur when the trencher boom is lifted to the position of FIG. 6** and the unit is used as an earth moving unit to close the trench.

Figure 5:
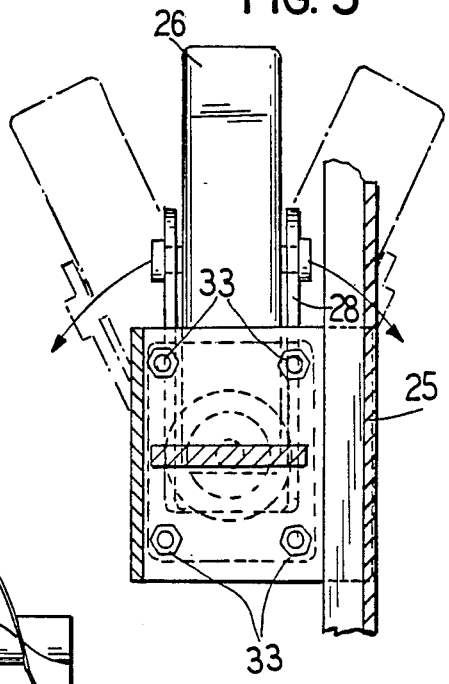
FIG. 5 is a fragmentary sectional view of one of the swivel supporting wheels of the trencher taken substantially along line V—V of FIG. 4.

For mounting the wheels and swivel arms, mounting blocks 35 and 36 are provided, illustrated in somewhat detail in FIG. 5. These are either clamped to the frame 25 or secured thereto by through bolts extending through frame openings and the bolts are shown such as at 33. Ball bearings 34 are provided to allow for free swivel movement of the arms.

By the location of the mount, it transmits a portion of the weight of the trencher to the tractor inasmuch as the center of gravity 31 is rearwardly of the mount. With the three-point hitch arrangement, a component of force is felt on the upper member 15 of the hitch to the left as shown in FIG. 3 so that the additional weight of the trencher carried by the tractor is felt by the rear wheels of the tractor increasing the traction thereof. This component of weight from the trencher is increased when the trencher is in operation as shown in FIG. 3 because the blades tend to pull downwardly on the trencher and this even increases the traction effect on the rear wheels of the tractor. Thus, the support wheels 26 and 27 in the arrangement disclosed not only permit immediate use of the tractor as an earth mover when the trench is to be closed without unhitching the trencher, but also permit backing and turning of the tractor. The wheels further are utilized in improving balance on the tractor and increasing rear wheel traction.

Figure 2:
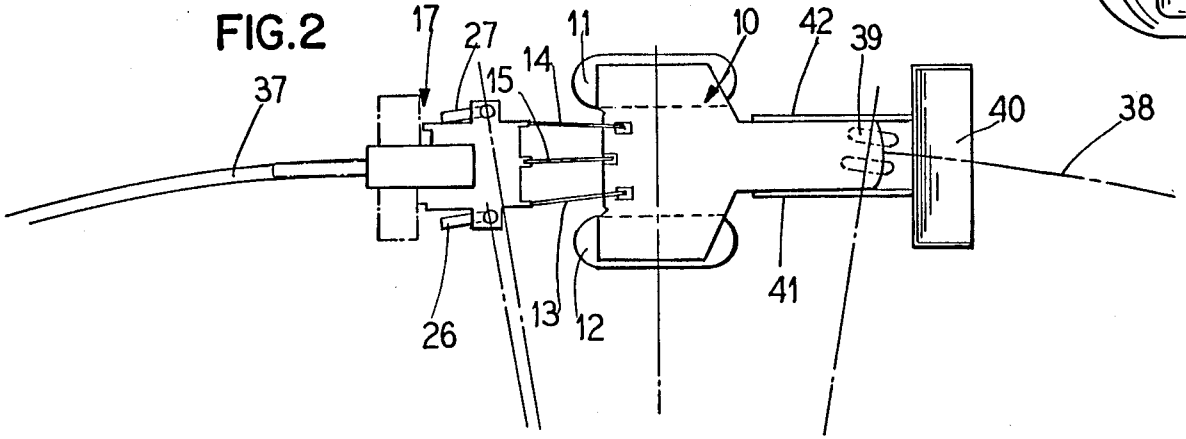
FIG. 2 is a top plan view, shown in somewhat schematic form of a tractor with an earth moving appliance on the front and the trencher connected on the tractor illustrating the operation wherein an arcuate trench is dug.

Another feature is that with the arrangement, cutting an arcuate trench is permitted. As shown in FIG. 2, the tractor has front wheels 39 which are turned slightly so that the tractor and trencher follow a general arc 38 cutting a curved trench 37. The boom of the trencher is sufficiently flexible to allow turning the tractor over a broad arc. Inasmuch as the trencher is relatively firmly fixed on the tractor by the three-point hitch provided by members 13, 14 and 15, the trencher wheels 26 and 27 swivel to allow for the arcuate trench.

Thus, it will be seen that we have provided an improved trencher and tractor arrangement which meets the objectives and advantages above set forth and provides improved capability and flexibility over structures heretofore available.

We claim as our invention:

1. An earth moving machine, comprising in combination:

a steerable self-propelled wheeled tractor having a front, a back, an engine, and a power takeoff;

a trencher on the back of the tractor having a frame with a boom pivotally mounted on the frame which supports an endless digging chain with blades and being driven from the power takeoff;

means for pivoting said trencher boom between a lower digging position and a raised non-digging position; and a pair of laterally spaced swivel support wheels each being connected to and carried beneath the frame on individual swivel arms swiveling on individual vertical axes and each pivotally connected to the frame at a location forward of a center of gravity of the trencher, said wheels being free to swivel at all time, said trencher frame being spaced sufficiently from the ground so that said wheels swivel beneath the trencher frame said swivel arms swiveling on the vertical axes and extending angularly rearwardly positioning the wheels closer to the center of gravity of the trencher than the connections between the arms and the frame; and a laterally rigid mount connecting the trencher to the tractor fixing the position of the trencher laterally with respect to the tractor so that the trencher is moved laterally when the tractor is steered and turned, said laterally rigid mount including a three-point hitch between the tractor and frame with two lower lateral connections and an upper connection wherein the trencher is located relative to the lower and upper connections so that vertical forces on the trencher boom in the digging position create a torque about an axis of the support wheels applying a force to the upper connection of the three-point hitch to increase the traction of wheels of the tractor on the earth.

* * * * *